US009962990B2

(12) United States Patent
Russell

(10) Patent No.: US 9,962,990 B2
(45) Date of Patent: May 8, 2018

(54) MOUNT APPARATUS FOR SHED ANTLERS

(71) Applicant: Zachary John Russell, Redmond, OR (US)

(72) Inventor: Zachary John Russell, Redmond, OR (US)

( * ) Notice: Subject to any disclaimer, the term of this patent is extended or adjusted under 35 U.S.C. 154(b) by 0 days. days.

(21) Appl. No.: 15/427,379

(22) Filed: Feb. 8, 2017

(65) Prior Publication Data

US 2017/0239979 A1 Aug. 24, 2017

Related U.S. Application Data

(60) Provisional application No. 62/298,567, filed on Feb. 23, 2016.

(51) Int. Cl.

| | |
|---|---|
| ***A47F 7/00*** | (2006.01) |
| ***A47F 5/08*** | (2006.01) |
| ***B44C 5/06*** | (2006.01) |
| ***A47F 7/14*** | (2006.01) |
| ***A47B 43/00*** | (2006.01) |

(52) U.S. Cl.

CPC ..... *B44C 5/06* (2013.01); *A47B 43/006* (2013.01); *A47F 5/0892* (2013.01); *A47F 7/143* (2013.01)

(58) Field of Classification Search

CPC ..... B44C 5/06; B44C 5/02; A47F 7/00; A47F 5/0006; A47F 2005/0012; A47F 5/08; A47F 5/0892; A47F 7/0021; A47F 7/143; A47G 25/00; A47G 25/06; A47G 25/0607; A47G 29/00; A47G 33/004; A47B 43/003; A47B 43/006; A47B 81/00; A01K 65/00; A22C 25/10

USPC ..... 211/13.1, 85.3, 30, 113, 118, 71.01; 224/103, 921

See application file for complete search history.

(56) References Cited

U.S. PATENT DOCUMENTS 413,661 A * 10/1889 Harman ..... A01K 65/00 224/103
809,359 A * 1/1906 Dial ..... A47F 7/08 211/113
825,753 A * 7/1906 Paul ..... A01K 65/00 224/103
1,815,673 A * 7/1931 Kelley ..... A47G 25/485 211/119
2,424,658 A * 7/1947 Hanson ..... A01K 65/00 224/103
2,714,965 A * 8/1955 Fitzkee et al. ..... A47G 25/743 211/113
2,953,828 A * 9/1960 Hochman ..... D06F 95/008 211/113
3,142,285 A * 7/1964 Sorrentino ..... B63H 11/00 440/42
3,188,130 A * 6/1965 Pietrowicz ..... A22B 5/06 224/921
3,202,293 A * 8/1965 Granvel ..... A47G 25/0685 211/30

(Continued)

*Primary Examiner* — Jennifer E. Novosad
(74) *Attorney, Agent, or Firm* — Hancock Hughey LLP

(57) ABSTRACT

Shed antlers are attached for display to a mount comprising an elongate bar that may be mounted to a wall. The bar includes plural attachment nodes and flexible tethers are connected to the attachment nodes. In a preferred embodiment the attachment nodes are defined by a sinusoidal rod that is attached to the elongate bar to define adjacent openings to which the tethers are connected. Shed antlers are attached to the tethers for display.

9 Claims, 4 Drawing Sheets

(56) References Cited

U.S. PATENT DOCUMENTS 3,394,790 A * 7/1968 Braun ..... A63C 11/007 194/256
3,482,747 A * 12/1969 Jones ..... A01K 65/00 224/103
3,561,652 A * 2/1971 Ruter ..... A01K 65/00 224/103
3,709,373 A * 1/1973 Aguilar ..... A47F 5/0892 211/113
4,124,154 A * 11/1978 O'Russa ..... A01K 65/00 224/103
4,286,717 A * 9/1981 Liesinger ..... A47L 13/512 211/70.6
4,387,873 A * 6/1983 Pavlo ..... A61G 7/0503 211/113
4,632,285 A * 12/1986 Dillingham ..... A47G 25/74 223/88
4,654,991 A * 4/1987 Jones ..... A63H 33/40 211/118
4,749,088 A * 6/1988 Workman ..... A47F 5/0892 211/113
4,811,852 A * 3/1989 Kelly ..... A47G 25/743 211/119
4,886,173 A * 12/1989 Goulter ..... A47F 13/085 211/120
4,971,593 A * 11/1990 Mayhall ..... A63H 3/50 211/70
5,109,578 A * 5/1992 Cox ..... A63B 60/62 24/298
5,117,988 A * 6/1992 Daniels ..... A47G 25/06 211/113
5,137,158 A * 8/1992 Brockway ..... B60R 7/02 211/106.01
5,141,116 A * 8/1992 Mojica ..... A47F 7/0028 211/60.1
5,203,462 A * 4/1993 Brooks ..... A47F 5/08 211/14
D342,357 S * 12/1993 Balk ..... D32/58
5,277,347 A * 1/1994 Savard ..... A01M 31/006 224/103
5,333,743 A * 8/1994 Loewke ..... A47G 25/0678 211/106.01
5,351,346 A * 10/1994 Hodges, Jr. ..... A47K 3/281 211/113
5,370,288 A * 12/1994 Field ..... A45C 13/02 211/60.1
5,601,197 A * 2/1997 Baxter ..... A47F 5/0006 211/113
5,613,614 A * 3/1997 Richardson ..... A47F 5/0884 211/89.01
5,642,817 A * 7/1997 O'Brien ..... A47G 25/743 211/60.1
5,770,303 A * 6/1998 Weinert ..... C08F 263/04 428/326
5,788,133 A * 8/1998 Mareno ..... B63B 23/62 114/343
6,000,591 A * 12/1999 Alexander ..... A45F 3/14 211/113
6,029,830 A * 2/2000 Manookian ..... A47F 5/083 211/118
6,076,685 A * 6/2000 Ramirez ..... A47F 5/0006 211/113
6,223,910 B1 * 5/2001 Levin ..... A47F 7/06 211/113
6,273,274 B1 * 8/2001 Lyles ..... A47F 7/06 211/113
6,330,949 B1 * 12/2001 DeRisio ..... A47F 5/0006 211/113
6,478,168 B1 * 11/2002 McNamee ..... A47F 7/12 211/115
7,040,517 B1 * 5/2006 Swanson ..... A47F 7/06 223/85
7,131,545 B1 * 11/2006 Grogan ..... A47G 23/0208 211/113
7,481,340 B2 * 1/2009 Murphy ..... A47G 25/743 211/113
7,585,197 B1 * 9/2009 Merten ..... B63B 27/146 182/136
7,789,250 B2 * 9/2010 Aamodt ..... A63B 47/00 211/118
8,020,712 B2 * 9/2011 Kopp ..... A42B 1/002 211/118
8,336,855 B2 * 12/2012 Griffiths ..... B44C 5/02 254/1
8,459,601 B2 6/2013 Shaw
8,511,485 B2 * 8/2013 Hernandez ..... A47F 5/0838 211/106.01
8,746,818 B2 * 6/2014 Meese ..... F25D 23/04 211/153
8,783,475 B2 * 7/2014 Carver ..... A47G 25/08 211/113
8,800,788 B1 * 8/2014 Guidry ..... A01K 97/10 211/70.8
D758,666 S * 6/2016 Carrillo ..... D28/73
9,441,785 B2 * 9/2016 Sterling ..... F16M 13/022
2004/0055343 A1 * 3/2004 Mahre ..... A63B 55/00 70/58
2004/0060881 A1 * 4/2004 Bell ..... A47F 7/005 211/87.01
2006/0016772 A1 * 1/2006 Plzak ..... A47F 5/0006 211/70.6
2008/0264884 A1 * 10/2008 Felder ..... B25H 3/00 211/117
2011/0108500 A1 * 5/2011 Sheffield ..... B66D 3/04 211/60.1
2012/0305509 A1 * 12/2012 Benson ..... F16M 13/022 211/85.7
2014/0034587 A1 * 2/2014 Herold ..... A47B 61/04 211/34
2015/0283935 A1 * 10/2015 Marinelli ..... B60P 7/0846 211/61
2017/0239979 A1 * 8/2017 Russell ..... B44C 5/06

* cited by examiner

MOUNT APPARATUS FOR SHED ANTLERS

TECHNICAL FIELD

The present invention relates to a mounting apparatus that may be used to mount shed antlers so that the antlers may be displayed. More particularly, the mount apparatus according to the invention is defined by an elongate bar member that includes multiple attachment points to which plural antlers may be attached.

BACKGROUND

Ungulates such as deer, elk and moose shed their antlers annually, and then grow a new set. Most typically, antlers are shed between January and April, although many factors can have an effect on when the antlers are shed, such as where the animal lives, its age, etc. Antler regeneration occurs through the spring and summer months.

Many people find so-called "shed antlers" to be very desirable. For example, outdoorsmen and women prize shed antlers for display and artists used shed antlers in the creation of many types of artworks. One of the more famous and recognized uses of shed antlers is at Jackson Town Square park in Jackson, Wyo., where there is an enormous arched gate at each of the four corners of the park that is made entirely of interwoven elk antlers.

Given the desire of many people to display shed antlers and use them in the creation of artistic works, there is a need for devices that provide a way to display them. However, like snowflakes, every shed antler is different from all others and as such it can be very difficult to design an apparatus that facilitates display. There are known devices for mounting animal trophies and one such device is disclosed in U.S. Pat. No. 8,459,601 for "Trophy Mount." The mount described in that patent is designed to mount and display a "European mount," which is typically a display using an animal's skull with associated horns or antlers. In order to mount the skull on the device of the '601 patent, the trophy mount utilizes a prong and associated arms that fit into a specific anatomical parts of the skull. But shed antlers are of course devoid of the animal's skull and the device of the '601 patent does not offer a way to mount and display shed antlers.

There is a need therefore for apparatus that facilitates mounting and display of shed antlers.

The present invention comprises a mount apparatus that provides a simple and convenient way to display shed antlers.

BRIEF DESCRIPTION OF THE DRAWINGS

The invention will be better understood and its numerous objects and advantages will be apparent by reference to the following detailed description of the invention when taken in conjunction with the following drawings.

DETAILED DESCRIPTION OF ILLUSTRATED EMBODIMENTS

The invention will now be described in detail with reference to the drawings. It will be understood that relative directional terms are used at times to describe components of the invention and relative positions of the parts. As a naming convention, the plane of the floor in a living or work space is considered to be a generally horizontal surface. The ceiling is a plane that in most installations is parallel to the floor, though not always. Other relative directional terms correspond to this convention: "upper" refers to the direction above and away from the ground plane; "lower" is generally in the opposite direction, "inward" is the direction from the exterior toward the interior of the adaptor, "vertical" is the direction normal to the horizontal ground plane, and so on.

Figure 1:
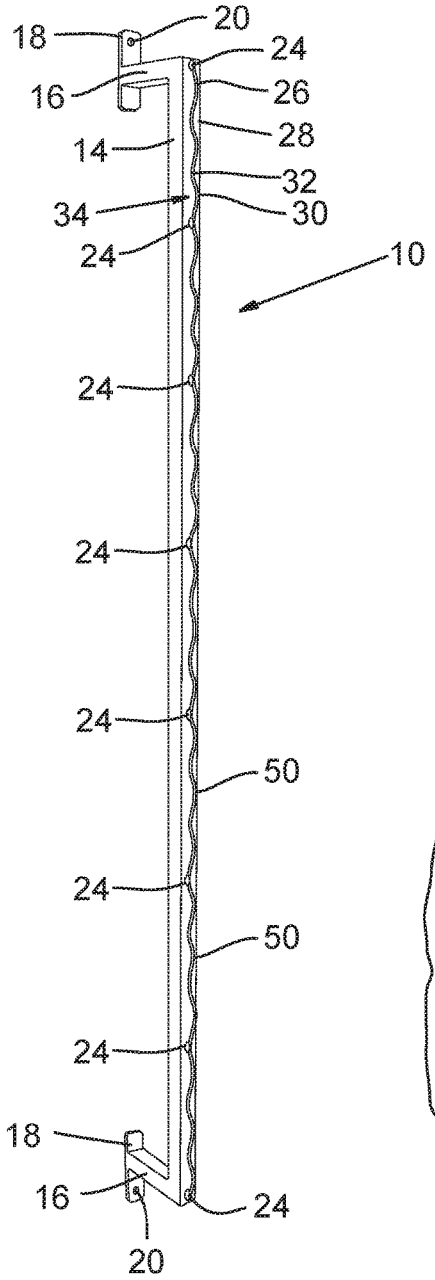
FIG. 1 is a perspective of the shed antler mount according to the present invention in which the mount oriented in a vertical orientation as it typically would be when mounted on a wall.

Turning now to the drawings, in FIG. 1 a first embodiment of a shed antler mount 10 according to the invention is shown mounted in a vertical orientation to a wall 12. Mount 10 comprises an elongate rod or bar 14 that has a standoff 16 at each end extending transverse to the axis of bar 14. Each standoff 16 has a foot plate 18 at the distal end of the standoff. The footplates 18 have a bore 20 so that a fastener 22 such as a bolt (FIG. 2) may be used to connect the mount 10 to the wall 12. Elongate bar 14 and standoffs 16 are shown in the drawings have a square cross sectional configuration but the invention is not limited to any particular shape for these components. Further, while metal components are preferred for ease of manufacturing and strength, the mount 10 may be made of other materials including wood, plastic, composites and the like and combinations of these materials. As detailed below, the rod 14 defines the base to which shed antlers are mounted with a mounting system.

Figure 2:
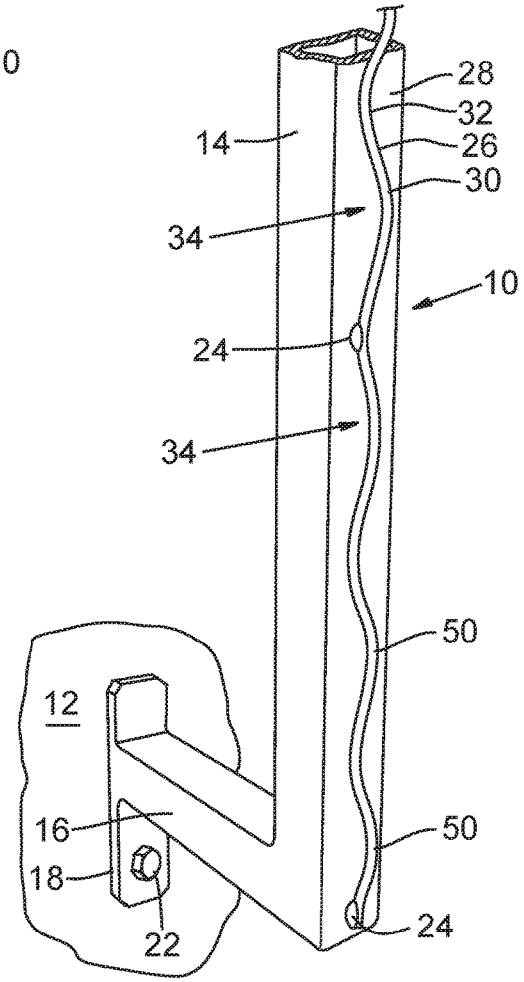
FIG. 2 is a close up perspective view taken of one end of the shed antler mount shown in FIG. 1 and showing the mount attached to a wall.

With specific reference to FIGS. 1 and 2, plural attachment nodes identified in the drawings generally with reference number 30 are defined along the length of elongate bar 14. As detailed below, the attachment nodes 30 are used in combination with tethers to attach shed antlers to the mount. The attachment nodes 30 can take on numerous different structural characteristics to accomplish their intended function: namely, as attachment points for tethers that in turn attach shed antlers to the mount. In a first preferred embodiment shown in FIGS. 1 and 2, the attachment nodes 30 are defined by an elongate rod 26 that is formed into a sinuous or sinusoidal wave form and which is attached to elongate bar 14 on the outer-facing surface 28 thereof. More specifically, elongate rod 26 is sinuous to define plural adjacent peaks 50 and adjacent valleys 32. The rod 26 is attached to the outer-facing surface 28 of elongate bar 14 by attaching the rod 26 at valleys 32. For example, where rod 26 is metal and elongate bar 14 is metal, the rod may be attached to the bar by tack welding 24 the rod to the bar at plural contact points at the valleys 32 where the rod is in contact with the outer surface 28 of the bar. Plural tack welds 24 are preferred, and ideally the rod 26 will be tack welded 24 at each point where a valley 32 makes contact with the outer surface 28. It will be appreciated that, and as shown graphically in FIG. 2, this manner of construction defines plural openings 34 between the peaks 50 and the elongate rod 14—there is an opening 34 between each adjacent valley 32. It will further be appreciated that the plural openings 34 may be formed in numerous other ways with numerous other structures. To name a few examples, rod 26 may have plural zigzags rather than the smooth sinuous form shown in the drawings, other serpentine shapes, or it may have right angles to define the plural openings. The plural openings could also be formed with independent devices such as loops that are individually attached along the length of bar 14.

Figure 3:
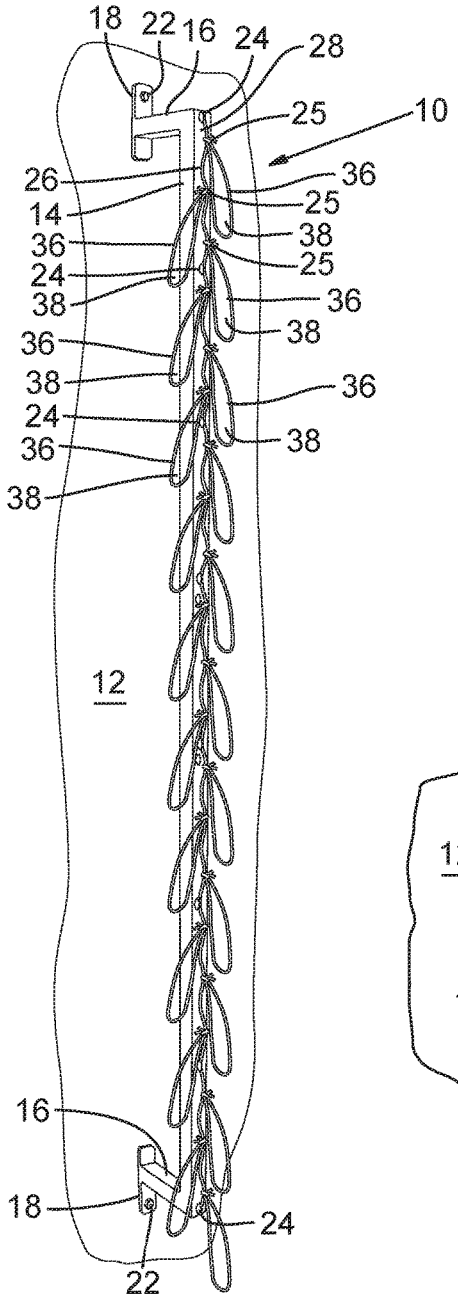
FIG. 3 is a perspective view of the shed antler mount according to the invention and as shown in FIG. 1, mounted vertically on a wall, and including tethers attached to attachment nodes.
Figure 4:
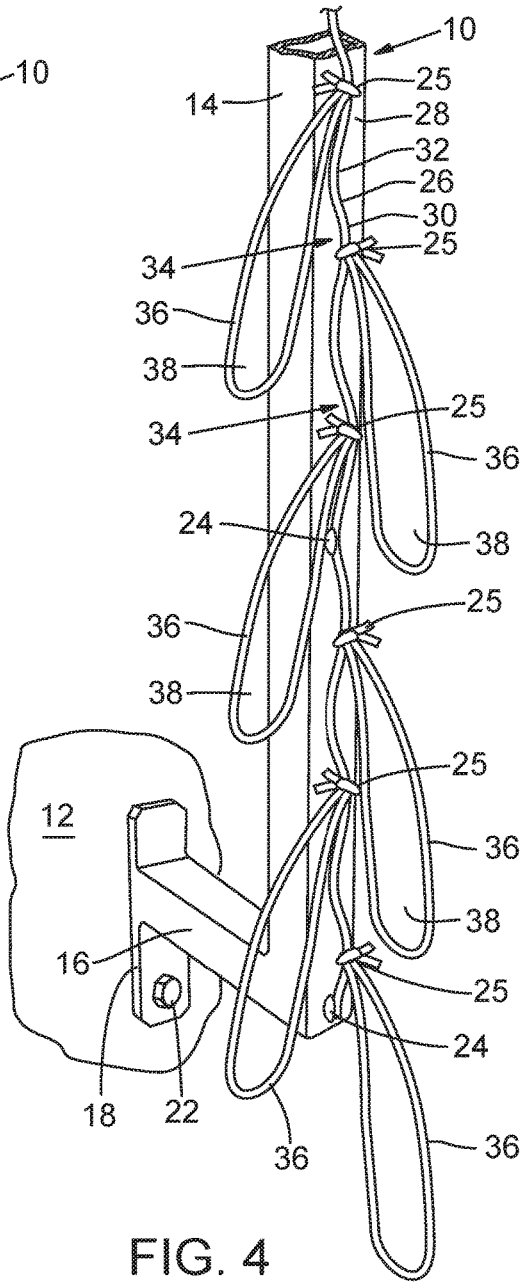
FIG. 4 is a close up perspective view of the lower end of the shed antler mount according to the present invention, similar to the view of FIG. 2, except the mount in FIG. 4 includes tethers attached to attachment nodes.

Attention is now turned to the drawings of FIGS. 3 and 4. Plural flexible tethers 36 are attached to mount 10—as explained below, a shed antler may be attached to each of the flexible tethers. More specifically, a single tether 36 is attached to rod 26 at each attachment node 30, that is, at an opening 34. In the embodiment of FIG. 3, each tether 36 is defined by a length of leather cord. The two ends of the cord are aligned and tied with a knot 25 to rod 26 at an opening 34 to define a closed loop 38. Leather is a preferred material for flexible tethers 36 because it fits with the natural look of mount 10. However, any flexible material may be used according to preference. And the loops 38 may be accomplished in numerous other ways. To name a few examples, fabric cord may be used instead of leather. Cord may be easily tied or welded to define the loops, and cord stops of various types may be used instead of tying.

Figure 5:
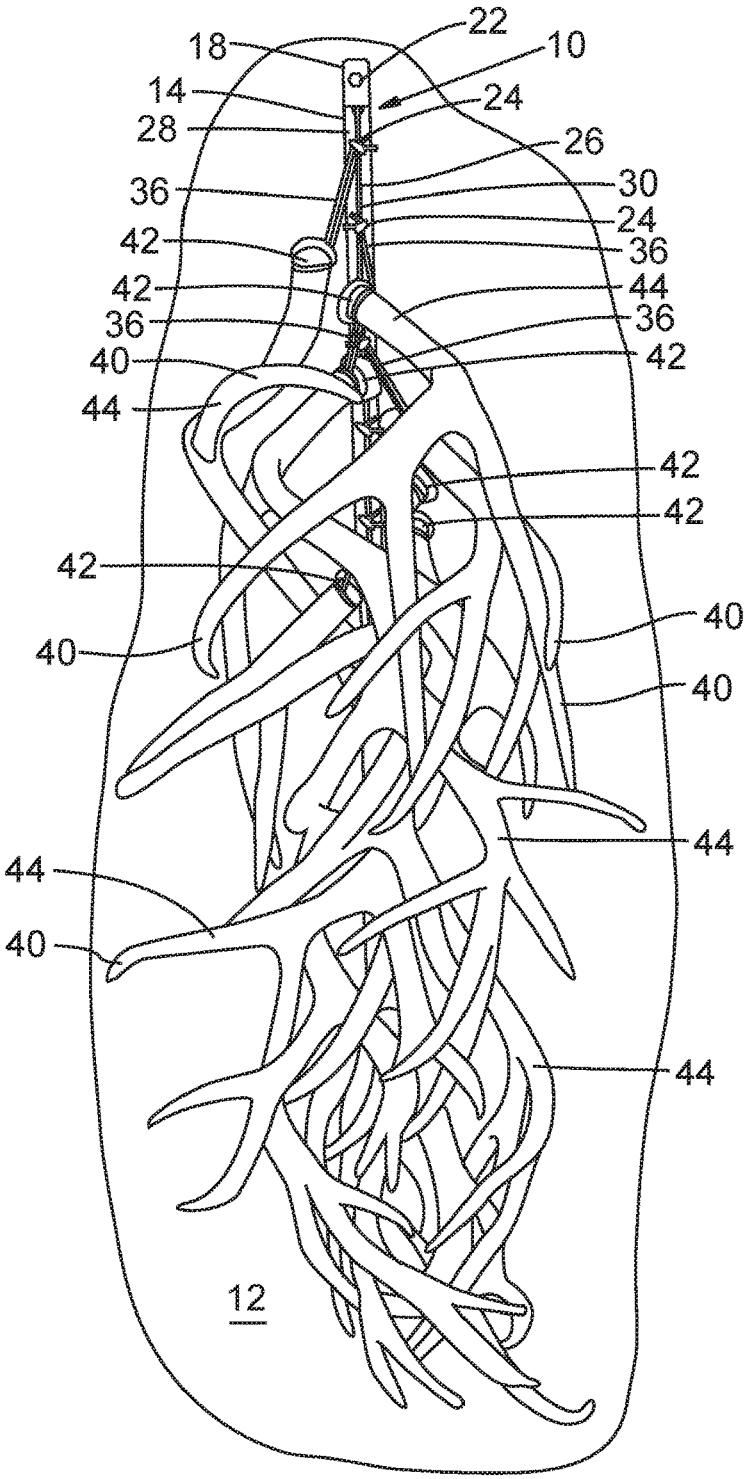
FIG. 5 is a front elevation view of a shed antler mount according to the invention on which plural shed antlers have been attached to plural tethers.
Figure 6:
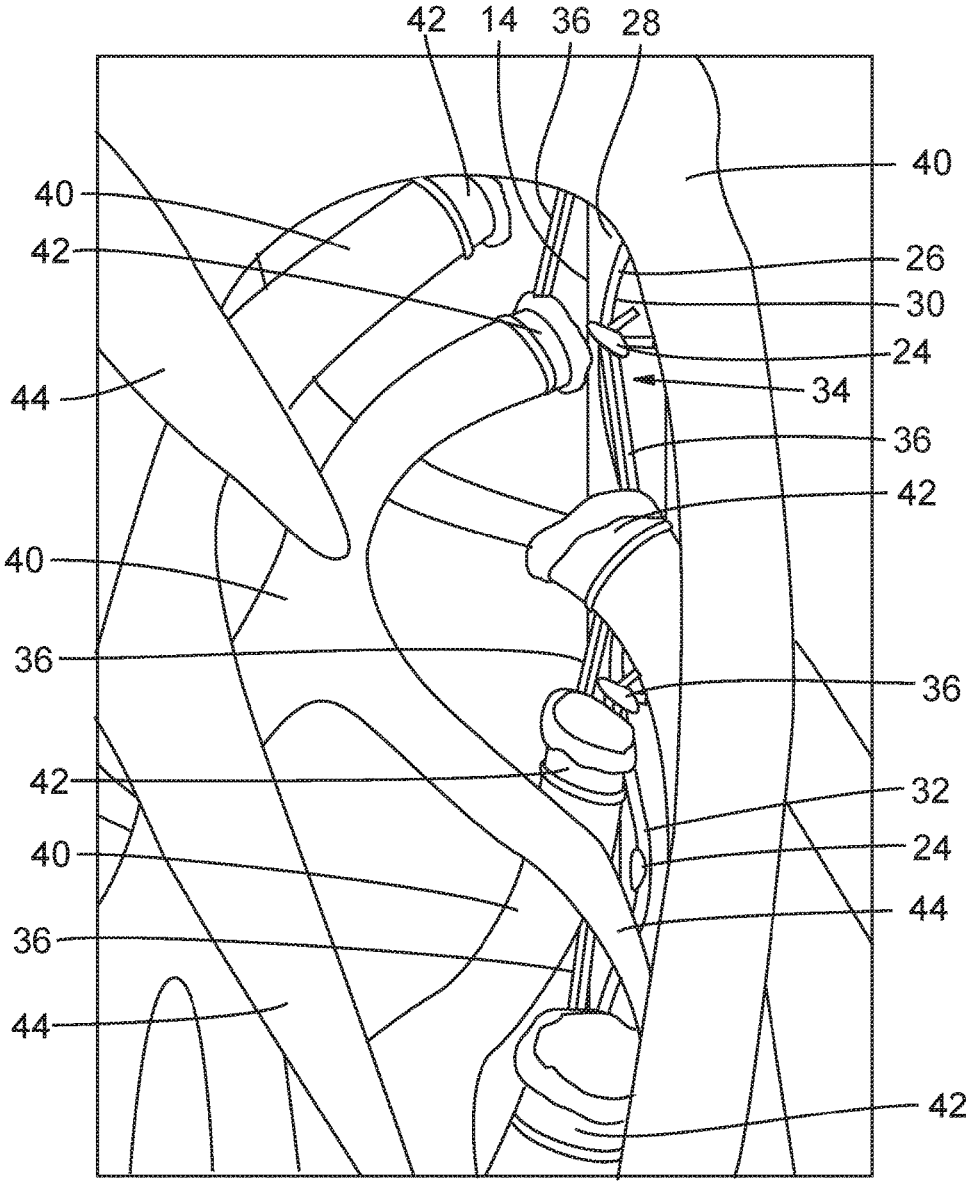
FIG. 6 is a close up view of the mount shown in FIG. 5 to illustrate the attachment of shed antlers to tethers.

Plural shed antlers 40 are shown attached to mount 10 in FIGS. 5 and 6. A whole (i.e., intact) shed antler 40 includes a basal structure/area known as a coronet or burr 42 that corresponds to the point where the antler grows from the animal's skull—called the pedicle. When the antler is shed, there is a slightly enlarged area at the coronet. To attach an antler 40 to a tether 36, the coronet is inserted into the loop 38 and the loop is tightened around the antler to securely attach the antler to the tether. The loop may be tightened around the antler in many ways, for example, with another length of leather cord, or by twisting the tether 36, or with a mechanical stop on the tether such as a spring-loaded cord stop, etc.

Plural shed antlers 40 may be attached to mount 10 by attaching an individual antler to each of the tethers 36. The best results are achieved working from the lowermost tether and working upwardly to attach subsequent antlers, but the specific order of attachment is not important. When plural antlers 40 are attached to the mount 10 as shown in FIGS. 5 and 6 the points 44 of neighboring antlers may be interwoven with each other to present a very attractive way to display the antlers.

Those of skill in the art will recognize that certain modifications of the structures described above may be made without changing the nature or scope of the invention. For example, in its broadest sense the invention is defined by means for defining plural attachments nodes to which shed antlers may be attached to an article. The attachment nodes may be defined, as described above, with a sinusoidal rod that is attached to an elongate rod. But attachment nodes according to the invention may also be made with a spirally wound rod that is wrapped around a base member and secured thereto. And, for example, the "base member" can take on the form of other utilitarian objects such as a lamp, a horizontal bar, or even a trellis or a wedding arch.

While the present invention has been described in terms of preferred and illustrated embodiments, it will be appreciated by those of ordinary skill that the spirit and scope of the invention is not limited to those embodiments, but extend to the various modifications and equivalents as defined in the appended claims.

The invention claimed is:

1. A mount for displaying shed antlers, comprising:

an elongate base rod;

plural attachment nodes on the elongate base rod, each attachment node defining an opening for attachment of a flexible tether, wherein the plural attachment nodes are defined by a sinusoidal rod that has adjacent peaks and valleys and the sinusoidal rod is attached to a surface of the elongate base rod with welds between plural valleys of the sinusoidal rod and the base rod and wherein each peak defines an opening for attachment of a flexible tether; and plural flexible tethers, each flexible tether attached to an opening of an attachment node.

2. The mount according to claim 1 wherein each tether comprises a closed loop.

3. The mount according to claim 2 including first and second stand offs attached to the elongate base rod and extending transverse thereto, and foot plates on each of the first and second stand offs for attaching the mount to a surface.

4. A mount for displaying shed antlers, comprising:

an elongate rod;

shed antler attachment means welded to the elongate rod for attaching plural shed antlers to the elongate rod, wherein the shed antler attachment means further comprises a sinusoidal member connected to the elongate rod such that plural attachment nodes are formed between the sinusoidal member and the elongate member, each attachment node defined by an opening between the sinusoidal member and the elongate rod, and plural tethers, each tether attached to an attachment node and each tether defining a loop adapted for receiving a burr of an antler to thereby secure a shed antler to the tether.

5. The mount according to claim 4 in which each tether is attached to one of the plural attachment nodes.

6. The mount according to claim 4 in which each tether further includes loop tightening means for tightening the tether onto the shed antler to thereby secure the shed antler to the tether.

7. A method of displaying shed antlers, comprising the steps of:

a) providing an elongate bar;

b) attaching to the elongate bar a sinusoidal member having adjacent peaks and valleys so that each of the adjacent peaks defines an opening between the sinusoidal member and the elongate bar and wherein each opening defines an attachment node, wherein the sinusoid member is attached to the elongate bar by welding plural valleys of the sinusoidal member to the bar;

c) attaching plural tethers to the sinusoidal member, each tether attached to an attachment node;

d) attaching plural shed antlers to plural tethers, each antler in the plurality attached to a tether.

8. The method according to claim 7 including mounting the elongate bar to a surface.

9. The method according to claim 8 in which the elongate bar is mounted to the surface such that the elongate bar is oriented vertically relative to a ground plane.

* * * * *